US006993947B2

(12) United States Patent
Tondo et al.

(10) Patent No.: US 6,993,947 B2
(45) Date of Patent: Feb. 7, 2006

(54) DEVICE AND METHOD FOR CALIBRATING A MULTIPLE-ROLLER FLATTENER

(75) Inventors: Fabrice Tondo, Vitry sur Orne (FR); Jacques-Yves Bourgon, Metz (FR); Dominique Bonnet, Vigy (FR); Christophe Noardo, Metz (FR); Gilbert Petig, Plappeville (FR); Pierre Vienot, Metz (FR)

(73) Assignee: USINOR SA, Puteaux (FR)

( * ) Notice: Subject to any disclaimer, the term of this patent is extended or adjusted under 35 U.S.C. 154(b) by 119 days.

(21) Appl. No.: 10/416,895

(22) PCT Filed: Nov. 14, 2001

(86) PCT No.: PCT/FR01/03557

§ 371 (c)(1),
(2), (4) Date: Sep. 17, 2003

(87) PCT Pub. No.: WO02/40191

PCT Pub. Date: May 23, 2002

(65) Prior Publication Data

US 2004/0089044 A1 May 13, 2004

(30) Foreign Application Priority Data

Nov. 17, 2000 (FR) ..... 00 14821

(51) Int. Cl.
*B21D 1/02* (2006.01)

(52) U.S. Cl. ..... 72/31.07; 72/164; 73/159; 73/862.046

(58) Field of Classification Search ..... 72/164, 72/31.07, 31.08; 73/159, 819, 824, 829, 73/862.046

See application file for complete search history.

(56) References Cited

U.S. PATENT DOCUMENTS

| | | | | |
|---|---|---|---|---|
| 3,315,506 | A * | 4/1967 | Schneider | 72/8.7 |
| 3,499,306 | A * | 3/1970 | Pearson | 72/11.7 |
| 3,789,657 | A * | 2/1974 | Ching et al. | 73/762 |
| 4,953,410 | A * | 9/1990 | Tabota | 73/862.046 |
| 6,216,546 | B1 * | 4/2001 | Bahr | 73/862.046 |
| 6,802,216 | B2 * | 10/2004 | van Schoor et al. | 73/159 |
| 6,860,148 | B2 * | 3/2005 | Kossuth et al. | 73/159 |

* cited by examiner

*Primary Examiner*—Daniel C. Crane
(74) *Attorney, Agent, or Firm*—Connolly Bove Lodge & Hutz LLP

(57) ABSTRACT

A metal measurement plate (5), having a size suitable for being placed between the set of upper rolls and the set of lower rolls of the leveler, has positioning means (60, 61, 62) for positioning it with respect to the rolls in the leveling direction, and strain gauges (51) for measuring elastic deformations of the plate during clamping on the leveler, said strain gauges being fastened to the plate so as to form several transverse rows of gauges (51 to 56) each located vertically in line with one of said rolls, on the opposite face of the plate with respect to said roll.

16 Claims, 4 Drawing Sheets

DEVICE AND METHOD FOR CALIBRATING A MULTIPLE-ROLLER FLATTENER

This application is a 371 of PCT/FR01/03557, filed Nov. 14, 2001.

FIELD OF THE INVENTION

The present invention relates to a device and to a method for calibrating a multi-roll leveler.

BACKGROUND OF THE INVENTION

Multi-roll levelers are used as finishing tools for leveling steel sheet. The general principle of leveling by multi-roll levelers, in particular of tension leveling, consists in making the sheet or strip to be leveled pass between two series of parallel rolls arranged so as to be mutually imbricated, the imbrication decreasing in the direction in which the sheet runs. As it passes between the rolls, it is deformed in bending alternately in one direction and then the other. The amplitude of bending decreases from the entrance of the leveler to the exit, so that the steel strip is subjected to a succession of alternating stresses suitable for eliminating or at least greatly reducing the internal stresses that cause flatness defects. The progressive reduction in the deformation amplitude makes it possible to obtain, at the exit from the leveler, a strip as flat as possible and with as few internal stresses as possible. In tension levelers, the strip is driven through the leveler between a pay-out reel and a take-up reel by "S-shaped" drive units which make the strip run and also tension it.

The ever tighter tolerances, in terms of flatness and internal stresses, imposed by strip or sheet users mean searching for the best possible way of controlling the operation of levelers, with preadjustments being carried out, and the best possible understanding of the mechanical characteristics of the machine: play, clearances, spring, adjustment parameters, etc.

To gain a better understanding of the problems involved in achieving the desired improvement in the control of the behavior of levelers, the reader will be reminded of the principal components of a multi-roll leveler in relation to FIGS. 1 to 5.

The drawing in FIG. 1 shows schematically such a leveler, which comprises a set of lower rolls 11 and a set of upper rolls 12, supported by a lower beam 13 and an upper beam 14 respectively. The metal strip 10 runs through the leveler between two motor-driven units 31, 32 of drive and tensioning drums arranged in an "S-shaped" configuration in the direction of the arrow F. The rolls are all parallel and offset between the top and the bottom, in the running direction of the strip, so that they can be mutually imbricated to a greater or lesser extent. As may be clearly seen, in the entry zone of the leveler, the strip is relatively highly deformed by undergoing alternating bending between the entry rolls 11*a,* 12*a,* 11*b,* etc., which are highly imbricated, whereas in the exit zone the deformations are very slight because the exit rolls 11*m,* 12*m,* 11*n* are only slightly imbricated or not at all.

The drawing in FIG. 2 also shows schematically an example of means for adjusting the leveler, in order to adjust the imbrication of the rolls. The upper beam 14 is held on an upper frame 15 by adjustments assemblies 16*a,* 16*b,* 16*c,* 16*d,* for example of the type consisting of a screw-nut with angle gear, two assemblies 16*a,* 16*b* being placed near the entry of the leveler and the other two 16*c,* 16*d* being placed near the exit respectively, and on each side in the longitudinal direction. The two entry adjustment assemblies 16*a,* 16*b* are connected by a drive shaft 17*a* and a coupling 18*a* and are driven together by an entry motor 19*a*. Likewise, the two exit adjustment assemblies 16*c,* 16*d* are connected by a drive shaft 17*b* and a coupling 18*b* and are driven together by an exit motor 19*b*.

The couplings 18*a,* 18*b* are used to temporarily uncouple the adjustment assemblies that they connect, in order to be able to adjust the transverse parallelism, or "dislocation", between the lower and upper rolls, and to do so both at the entry and the exit of the leveler. Next, the imbrications of the rolls of the leveler are adjusted by means of motors which drive, simultaneously and in an identical manner, the adjustment assemblies, either at the entry of the leveler or at the exit.

The parallelism or dislocation adjustment is carried out only in the case of major interventions on the leveler. Calibration of the leveler is carried out more frequently, in order to readjust the imbrications of the rolls or to modify them according to the characteristics of the strips to be leveled.

FIG. 3 shows, also schematically, the leveler, seen from the front, in order to show the means for adjusting the bending or the crown of the rolls. This is because, during leveling, the bending forces exerted on the strip result, in reaction, in deforming the leveling rolls. To compensate for such deformation and prevent it in return from causing geometrical defects in the strip, the leveling rolls are in fact supported by back-up rolls that are themselves supported by press rolls. This assembly is mounted in a frame called a cassette placed on a set of tapered wedges or of actuators or else against supports that are independent and height adjustable, these being distributed over the width of the leveler. In the example shown in FIG. 3, there are eleven rows of press rolls 21 placed over the width of the leveler. The vertical position of the press rolls may be adjusted by means of adjustable tapered wedges 22, each acting under all the press rolls located on the same line parallel to the running direction of the strip and over the entire length of the leveler. The shape of the leveling rolls therefore depends on the vertical position of the press rolls.

An example of an adjustable press-roll system is shown in FIG. 5. In this example, the height of the press rolls is adjustable by means of tapered wedges 23 which are interposed between the support rolls and a rigid lower frame 15' and which slide one over the other. The relative displacement of the tapered wedges is effected by a cylinder 24, and may be measured, for example, by a position sensor 25.

In the case of FIG. 3 for example, such systems have three press rolls 22*a,* 22*b,* 22*c* and 22*i,* 22*j,* 22*k* located on each side near the ends of the rolls, where the deformations are greatest. In the central part, it is unnecessary to use such adjustable press rolls. As may be seen in FIG. 4 in a highly exaggerated manner, the press rolls make it possible, by exerting under the rolls a vertical force of greater or lesser magnitude, to deform the latter, when empty and also under load, so that, during leveling, their profile is suitable for correcting the defects observed on the strip to be leveled.

To effect the overall adjustment of a leveler, there is therefore:

adjustment of the parallelism, or dislocation, of the leveler that is to say substantially the adjustment of the parallelism between the lower rolls and the upper rolls, this adjustment being carried out by acting on the screws for adjusting the position of the upper beam, taken independently between the adjustment screws on the right side and on the left side, after separating the couplings 18*a,* 18*b;* adjustment of the imbrication of the rolls, at the entry and at the exit of the leveler, the amount of imbrication being as a general rule monitored by measuring the angle of rotation of the screws for adjusting the position of the upper beam, or by displacement sensors between the beams at the leveler entry and exit;

adjustment of the crown of the rolls by means of actuators, as described above, the value for each press roll being determined by the measurement made by the sensors 25;

tension in the strip, generated by the "S-shaped" tensioning units, the value of the tension being measured by a tensometer or from the electrical parameters of the reel motors; and elongation generated during leveling and measured by a speed differential between entry tensioner and exit tensioner.

Moreover, the precise geometry of the pass path of the strip, on which the quality of the leveling depends, itself depends on the forces generated during the pass and on the deformations of the strip, which forces and deformations cause deformations of the machine, called spring (or deflection or camber, cédage in French).

To be able to exert effective control of the leveling, it is necessary to know as precisely as possible the actual position of the leveling rolls and their geometry permanently during operation. It is therefore necessary to be able to determine what the geometry and the position of the rolls are according to all the other parameters that can have an influence on the rolls, that is to say the settings given to the various actuators and also the forces generated, that are likely to modify the geometry and the actual position of the rolls.

To be able, with full knowledge of the situation, to adjust the leveler according to the characteristics of the strip to be leveled and to be able to set the actuators, especially the motors for adjusting the imbrications, it is therefore necessary to calibrate or set the leveler, that is to say to determine the base adjustments of the leveler that are suitable for obtaining the desired leveling.

It is also highly desirable to be able to establish a relationship between the adjustment values that are controlled by the available actuators and the geometrical modifications of the leveling path during operation, in other words to know the spring of the leveler and to take this into account in the adjustment of the imbrication motors, in order as it were to compensate in advance for the spring that will be experienced during actual working.

Currently, the calibration of multi-roll levelers is conventionally carried out under no load using ground steel spacers, or under load using metal spacers and lead bars, that are slid between the beams of the leveler, then the beams are closed up in a parallel fashion until a precise gap is obtained between the two sets of lower and upper rolls, said gap being defined by a ground steel spacer, for example 8 mm in thickness, placed between the two sets of rolls. The leveler is thus placed under loading conditions suitable for compensating for the inevitable mechanical play and in a stress state defined by the compression of the lead spacers. The position of the leveler tightening screws in this state is then noted, said position then being taken as reference, with respect to which the subsequent working position is adjusted by bringing said adjustment screws into the position corresponding to the desired working position of the rolls and being based on the relationship linking the displacement of said screws to the corresponding displacement of the rolls. It is also possible to adjust the parallelism using this method, or to compensate for the dislocation, and even possibly to act on the press rolls in order to adapt the bending or the crown of the rolls, but only in an approximate manner.

During the abovementioned calibration procedure, the actual force undergone by the beams, due to the compression of the lead spacers, remains unknown and is therefore not reliably representative of the forces encountered during actual working.

In particular, the known method has the consequence, observed experimentally, of causing overtightening during the leveling of thin strip.

As a result, the residual curvatures—bow and crown—are not controlled satisfactorily.

SUMMARY OF THE INVENTION

The object of the present invention is to solve the abovementioned problems. In particular, it is an object of the invention to allow the characteristics of a multi-roll leveler to be determined more accurately, by carrying out a calibration under load, which is reproducible and under known forces. It is also an object of the invention to determine the overall spring of the leveler, under various loads, so as to be able to incorporate these values into adjustment models. It is also an object of the invention to determine the influence of the press-roll adjustments more accurately so as to be able to refine the adjustments of the latter and be able to correct the transverse spring of the leveling rolls, in order finally to obtain better flatness of the leveled strip.

It is also an object of the invention to correct the dislocation of the leveler and its "tilt". It is also an object of the invention to make it possible to study the ability of a multi-roll leveler to provide precise and reproducible adjustments corresponding to standard leveling loading cases.

With these objectives in mind, the subject of the invention is a device for calibrating a multi-roll leveler in order to level a metal strip, comprising a set of lower rolls and a set of upper rolls, arranged approximately in a parallel manner, perpendicular to the leveling direction in which the strip to be leveled runs.

According to the invention, the device is characterized in that it includes a measurement plate made of metal, especially one with a high yield strength, and having a size suitable for being placed between the set of upper rolls and the set of lower rolls, extending approximately over the entire length of said rolls, said plate having positioning means for positioning it with respect to the rolls in the leveling direction, and strain gauges for measuring the elastic deformations of the plate, said strain gauges being fastened to the plate so as to form several transverse rows of gauges each located vertically in line with one of said rolls, on the opposite face of the plate with respect to said roll.

The subject of the invention is also a method for calibrating a multi-roll leveler, using the device of the invention, characterized in that the measurement plate is placed in the leveler, positioned by the positioning means so that each row of gauges is located vertically in line with a roll, and the two sets of rolls are brought closer together so as to exert a clamping force on the measurement plate, and the deformations undergone by the plate in line with each roll located vertically in line with the gauges is measured by means of said gauges, in order to deduce therefrom the clamping force applied by the rolls in line with each gauge, and the actual clamping between rolls.

By using the strain gauges placed vertically in line with the rolls, it is possible to measure the surface bending deformations of the plate that are caused by the rolls bearing on the plate, and to deduce therefrom, knowing the mechanical properties of the plate, the magnitude of the bearing force on each gauge. From these measurements, it is therefore possible to have a precise knowledge of the characteristics of the leveler, from the standpoint of the geometry of the leveling path defined between the rolls.

Firstly, preferably, the plate has at least one row of gauges that is located so as to be placed vertically in line with one of the rolls located near the entry of the leveler and at least one row of gauges located so as to be placed vertically in line with one of the exit rolls. It is thus possible to determine the entry and exit clamping forces on the leveler and, for example, to consequently set the motors for controlling the position of the upper beam in a position corresponding to identical clamping at the entry and at the exit, in order subsequently to be able to determine the difference in actual clamping between entry and exit, and therefore the difference in imbrication between the entry rolls and the exit rolls. It will be noted that the gauges are not placed in line with the first, upper or lower, roll or in line with the last, upper or lower, roll so that the measurements will be carried out only in line with rolls that are loaded just substantially vertically.

Also preferably, a row of gauges includes at least one gauge located in the central line and a gauge on each side toward the edges of the leveler, thereby making it possible to determine, and therefore correct if necessary, differences in clamping between the sides of the leveler. In combination with the abovementioned measurements, it becomes possible to detect, and therefore also correct, dislocations of the leveler.

Also preferably, one row of gauges includes a central gauge and several lateral gauges placed so as to each be located vertically in line with each press roll of the leveler. It is therefore possible to further improve the precise knowledge of the characteristics of the leveler from the standpoint of the geometry of the leveling path defined between the rolls, in particular the transverse profile of this path, which is defined by the shape of the generatrix of the rolls in contact with the measurement plate.

It is then possible to act on the press rolls in order to correct defects in parallelism between the rolls, for example by adjusting the press rolls of the leveler so that the deformations measured by each gauge for the same roll are equal and have predetermined values, in such a way that the gap between two successive rolls, that is to say an upper roll and a lower roll, is constant over the width of the leveling path, or corresponds to predetermined values suitable for correcting the specific defects of a sheet to be leveled.

What has just been described relates essentially to characteristics relating to the geometry of the leveling path, making it possible to have the greatest possible knowledge about its geometry once the various elements of the leveler have been placed under conditions corresponding to the working conditions, in particular under a load capable of overcoming the various amounts of play of the rolls and of their supports and of the adjustment and control members.

The invention thus makes it possible to assess the behavior of the leveler under load, by determining the overall clamping force in various measured positions of the clamping control means and by deducing therefrom a spring curve for the leveler, which can then be taken into account for making the preadjustments for the work, according to the dimensional characteristics and mechanical properties of the strip to be leveled, and according to the magnitude of the imbrication of the rolls needed to correct the known defects of said strip, for example. Instead of considering the overall clamping force determined from all the measurements carried out by all the gauges, more localized clamping variations could also be determined, for example to distinguish the specific spring of each column of the leveler, or to allow the behavior of the press rolls during load variations to be independently monitored.

It should be noted that the instrumented plate according to the invention is typically a steel plate having a high yield strength, for example 1000 MPa, and a thickness for example of about 0.7 mm, and in any case a thickness very much greater than that of the strip to be leveled, which typically has a thickness of 0.1 to 0.2 mm for example.

To determine the characteristics of the plate, it is also necessary to take into account the following considerations:

- the measurement plate must not undergo plastic deformation, which could in particular arise as a result of too deep an imbrication of the rolls. Too deep an imbrication of the rolls may run the risk of deforming the measurement gauges excessively;
- the thickness of the plate is determined so as to apply, by elastic bending, the leveling forces usually supported by the leveler;
- furthermore, a maximum thickness of the plate is determined in order to avoid having to reduce the sensitivity of the measurements; and
- the yield strength of the plate is determined according to the thickness and so as to prevent plastic flow when the plate has to apply the usual maximum leveling forces.

In order for the measurements carried out to be reliable and reproducible, it is of the greatest importance for the measurement gauges to be precisely located in the position of greatest relative deformation, that is to say at the top of the undulations generated by application of the clamping force. For this purpose, the positioning means include at least two sets of positioning gauges placed toward each lateral edge of the plate respectively, as far away as possible from each other, vertically in line with the same roll, in order to allow the position of the plate with respect to this roll in the leveling direction, and therefore the relative position of all the rows of measurement gauges with respect to their respective rolls to be accurately determined.

For the position of the plate to be accurately adjusted, it includes, on one edge transverse to the direction of leveling, adjustable bearing stops placed so as to bear against one of the end rolls, the entry roll or the exit roll, of the leveler at the height of the axis of said roll. By acting on these stops, which can be finely adjusted for example by means of micrometer screws, the position of the plate is therefore adjusted so that the positioning gauges indicate that they are perfectly centered with respect to the roll. To facilitate this positioning and increase its accuracy, the positioning gauges are preferably gauges of a type known by the name "daisy chain", conventionally made in the form of a set of five strain gauges joined in line over an overall length of around one centimeter. Each daisy chain is accurately cemented onto that face of the plate on the opposite side from a work roll, so that the axis of the central gauge of the daisy chain is in perfect vertical alignment with the axis of said roll.

The positioning of the plate is carried out by observing the signals output by each gauge of the daisy chain, until symmetry is obtained with respect to the gauges located on each side of the central gauge, on the one hand, and until a maximum is detected by the central gauge, on the other hand, said maximum being indicative of the central gauge being just in vertical alignment with the axis of the roll, in which the curvature of the plate is the most pronounced.

Other features and advantages of the invention will emerge from the following description of a device according to the invention and of its operation.

Reference will now be made to the appended drawings in which:

DETAILED DESCRIPTION OF THE INVENTION

Figure 1:
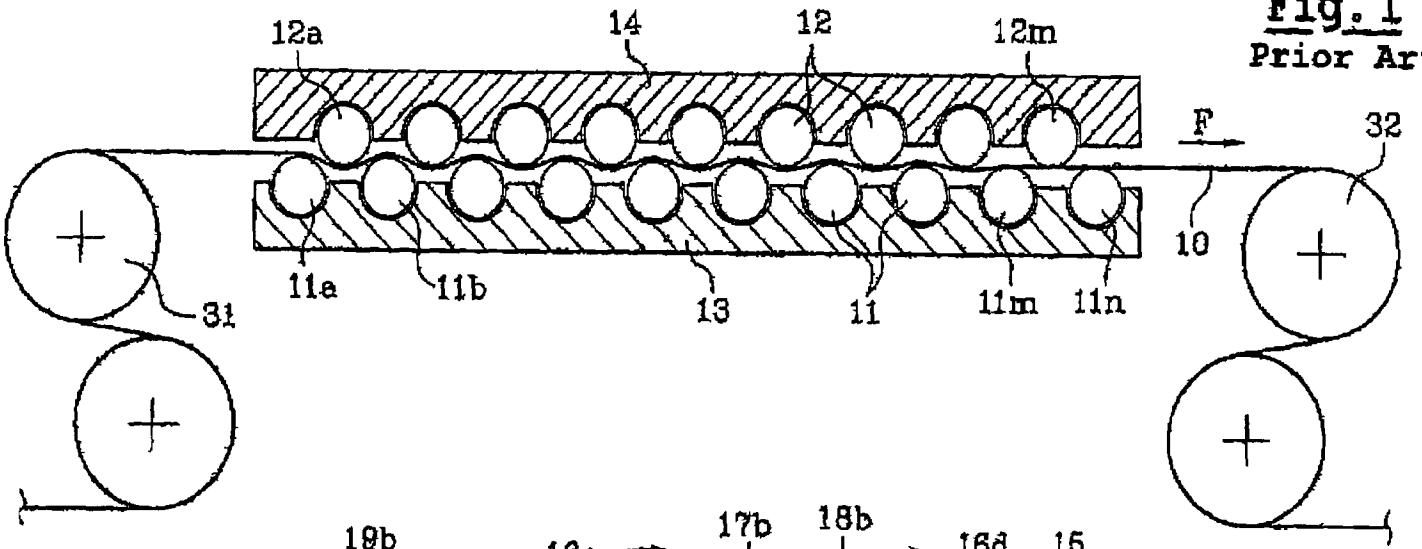
Fig. 1 Prior Art
FIGS. 1 to 5, which illustrate the principle and the construction of a multi-roll leveler, have already been commented upon.
Figure 2:
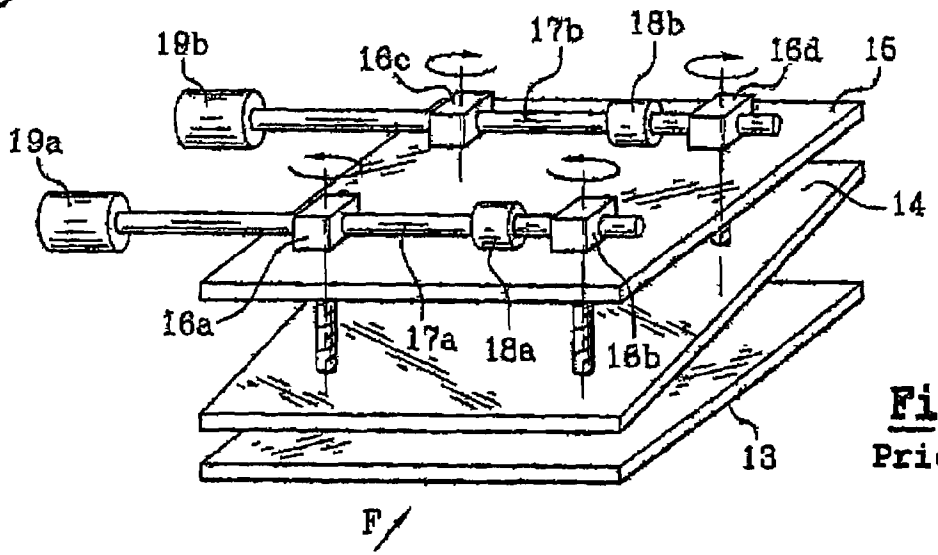
Fig. 2 Prior Art
Figure 3:
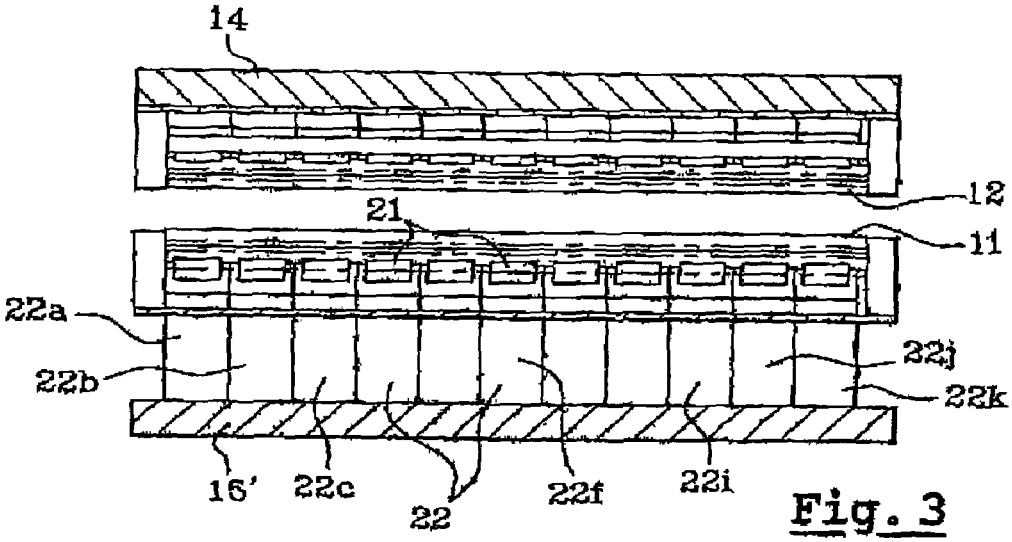
Fig. 3 Prior Art
Figure 4:
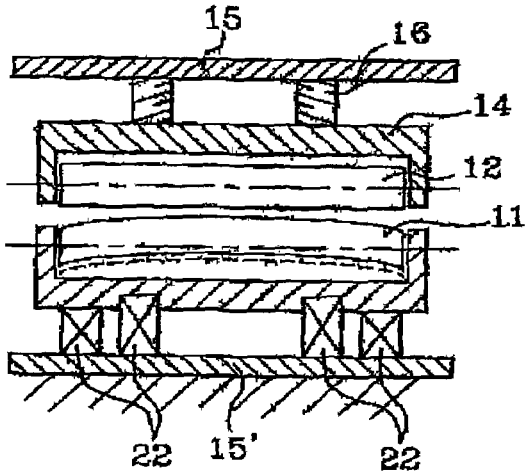
Fig. 4 Prior Art
Figure 5:
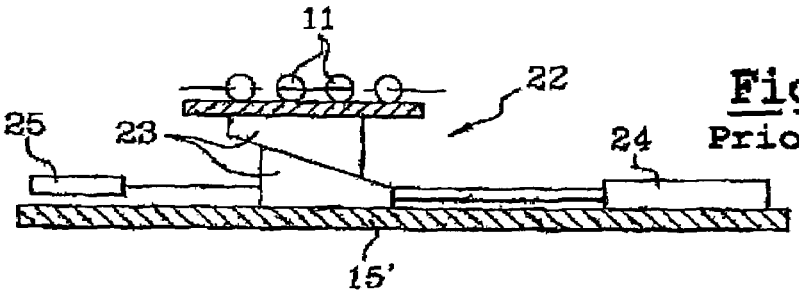
Fig. 5 Prior Art
Figure 6:
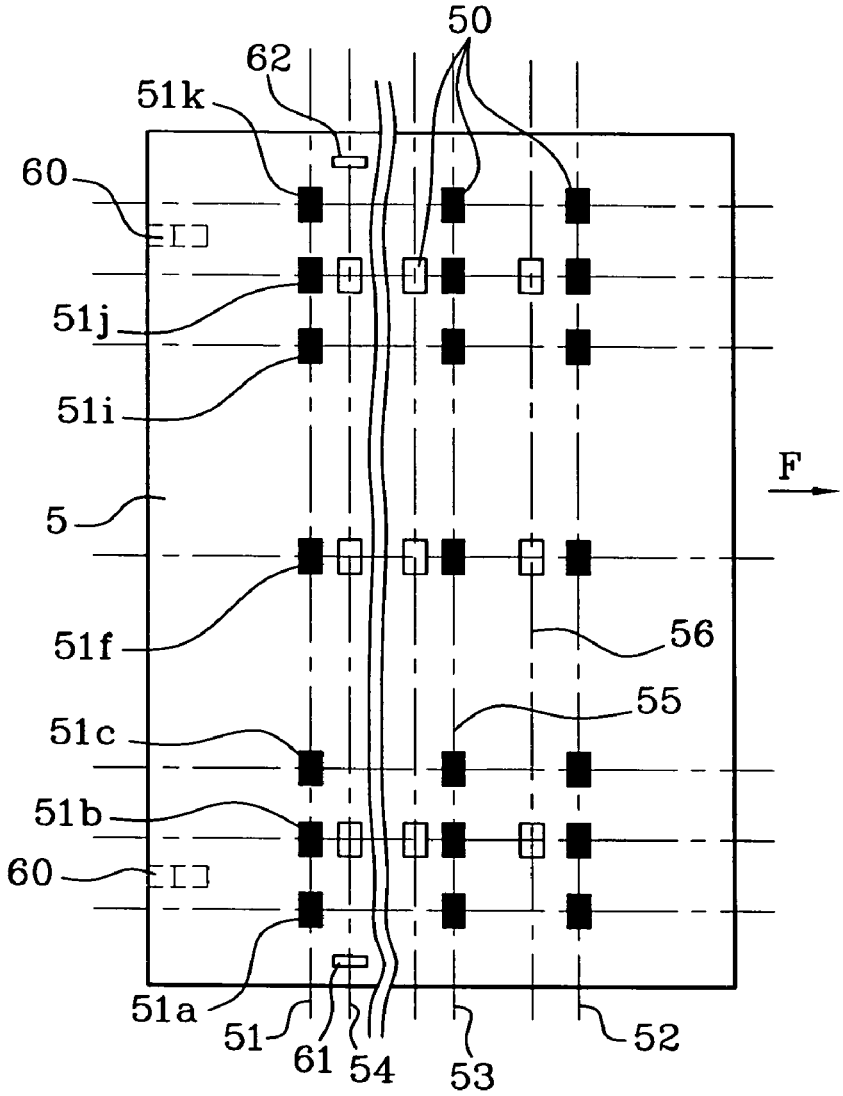
FIG. 6 is a partial view of a measurement plate according to the invention.
Figure 7:
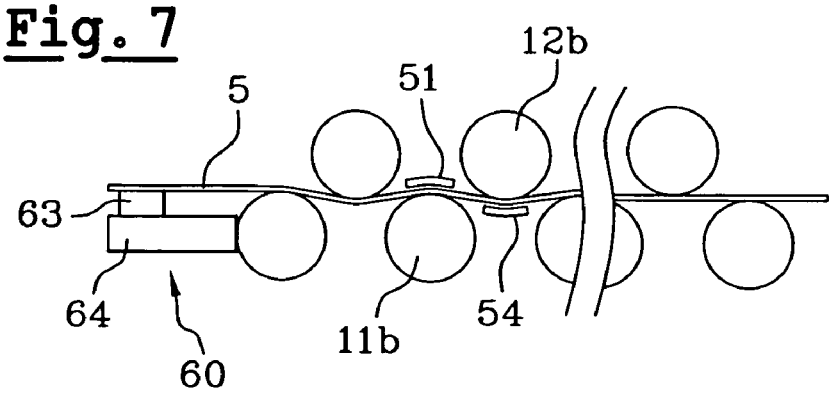
FIG. 7 illustrates the positioning of the plate in the leveler, in accordance with the invention.

The instrumented plate 5 given by way of example and produced for one particular type of multi-roll leveler, shown in FIG. 6, is typically a plate of sheet steel having a high yield strength, a thickness of 0.7 mm and measuring 500 mm in the leveling direction and 1 m in the transverse direction. It carries several rows of strain gauges 50 cemented to the surface of the sheet, in the following manner:

A first row 51 of gauges is located on the upper face, to be positioned vertically in line with the second lower roll 11*b,* as may be seen in FIG. 7; a second row 52 of gauges is placed in a similar manner vertically in line with the penultimate lower roll; and a third row 53 is preferably placed level with a central roll of the series of rolls.

Each of these rows has seven gauges, such as the gauges 51*a,* 51*b,* 51*c,* 51*f,* 51*i,* 51*j,* 51*k,* in the first row, placed vertically in line with the press rolls 22*a,* 22*b,* 22*c,* 22*f,* 22*i,* 22*j,* 22*k,* respectively.

Other rows of gauges are placed on the lower face of the plate 5, such as a row of gauges 54 placed vertically in line with the second upper roll 12*b,* a row 55 placed vertically in line with the penultimate upper roll and a row 56 placed vertically in line with a central roll of the series of upper rolls. Each of these rows has for example three gauges, placed vertically in line with the press rolls 22*b,* 22*f* and 22*j* respectively. Additionally, placed in alignment on the row 54, and near the edges of the plate, are positioning gauges 61, 62 consisting of daisy chains of five gauges aligned in the leveling direction, of a type known per se, and the central gauge of which is located precisely on the line 54.

The plate 5 also has two adjustable stops 60, each having a fixed part 63 fastened to the plate 5 and a moving part 64 that can be adjusted with respect to the fixed part, for example by a micrometer screw, and the end of which is positioned so as to butt against the first lower roll, as shown in FIG. 7.

To take a measurement, the plate 5 is placed between the lower rolls and the upper rolls and clamping starts by actuating the motors 19*a,* 19*b.* The indications given by the positioning gauges 61, 62 make it possible to check that the row of gauges 54 is correctly positioned vertically in line with the roll 12*b* and if necessary to correct its position using the adjustable stops 60, with a precision of the order of 0.1 mm. This first step of the measurement is key for ensuring perfect parallelism between the rows of gauges and the rolls, and the precise positioning of each alignment of gauges in the vertical plane passing through the axis of the corresponding roll.

The clamping measurements may then be made by means of the various gauges.

Figure 8:
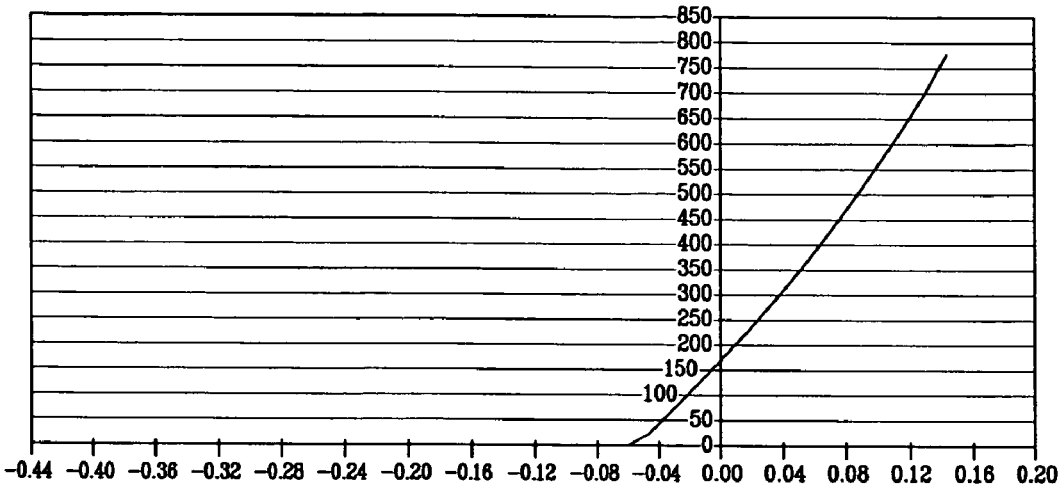
FIG. 8 is a graph showing by way of an example a spring curve determined using the measurement plate.

By varying the clamping, overall measurements, or measurements integrated over all or some of the gauges on the plate, will make it possible, for example, to determine the forces supported by the beams and the spring of the leveler. FIG. 8 shows by way of an example the spring curve for a column located on the exit side of a leveler, obtained by using the measurement plate according to the invention, the spring being plotted on the x-axis in mm and the roll clamping forces plotted on the y-axis in daN.

Such a spring curve can then be incorporated into the leveler adjustment parameters.

Figure 9:
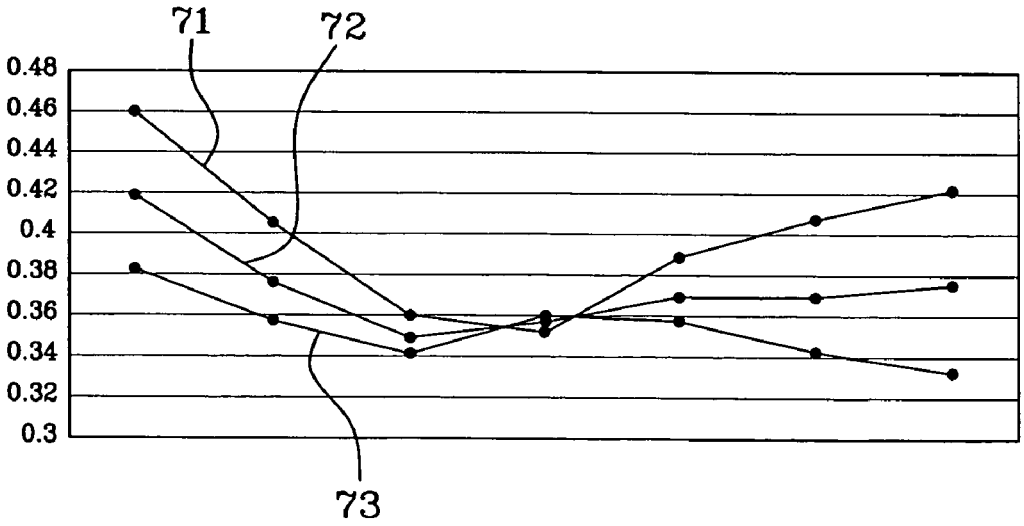
FIG. 9 is a graph illustrating the profile of the rolls under load at the entry of the leveler, especially showing how the adjustment of the press rolls has an influence on the profile.

By observing the values given by each of the gauges separately, it is possible to determine a load profile for each roll placed in correspondence with a row of gauges. The graph in FIG. 9 shows, for example, the profile of the entry rolls of a leveler. Plot 71 corresponds to a 0 setting of the press rolls; plot 72 to a −0.05 mm setting; plot 73 to a −0.1 mm setting. Each point on the plots corresponds to a measurement gauge and the values indicated on the y-axis represent the clamping of the rolls on the plate, this being determined from the measurements taken. These measurements taken with the instrumented plate according to the invention allow the usual adjustments to be validated, that is to say a setting of the press rolls of −0.1 mm, carried out empirically in order to obtain manifestly good flatness. The measurements taken according to the invention therefore make it possible to obtain a good image of the clamping forces along the transverse direction that are actually applied in the leveler. They also make it possible to refine the adjustments of the press rolls in order to obtain better flatness.

The invention is not limited to the embodiment of the instrumented plate described above solely by way of example. In particular, the number and the arrangement of the rows of gauges and the number of gauges per row may be modified, according to the number of rolls in the leveler, the number of press rolls and the measurements that are desired. In addition, the positioning gauges and the adjustable stops may be replaced with equivalent means suitable for positioning as precisely as possible the rows of measurement gauges vertically in line with the rolls.

It should also be noted that, although a priori it is envisaged to characterize the leveler for the maximum leveling width, using a measurement plate of this width, it is also possible to characterize the leveler for working in a given sheet size, different from the maximum size, using a measurement plate having dimensions identical to that of the product for which it is desired to characterize the leveler. The plate will then preferably be placed so as to be centered longitudinally in the leveler. The characterization of the leveler may then be used subsequently to adjust it, even for leveling sheet of smaller size.

What is claimed is:

1. A device for calibrating a multi-roll leveler in order to level a metal strip, the leveler having a set of lower rolls and a set of upper rolls, arranged approximately in a parallel manner, perpendicular to the leveling direction in which the strip to be leveled runs, the calibrating device comprising:

a measurement plate made of metal and being placed between the set of upper rolls and the set of lower rolls, said plate extending approximately over the entire length of said rolls;

means for positioning said plate with respect to the rolls in the leveling direction; and strain gauges for measuring elastic deformations of the plate, said strain gauges being fastened to the plate so as to form several transverse rows of gauges each located vertically in line with one of said rolls, on a face of the plate opposite that confronting a corresponding roll.

2. The device as claimed in claim 1, wherein said plate has at least one row of gauges located so as to be placed vertically in line with one of the rolls located near an entry of the leveler and a row of gauges located so as to be placed vertically in line with one of the rolls located toward an exit of the leveler.

3. The device as claimed in claim 1, wherein one row of gauges has at least one gauge located on a central line of the plate, and gauges toward each transverse edge of the plate.

4. The device as claimed in claim 3, wherein one row of gauges has a central gauge and several lateral gauges placed so as to each be located vertically in line with each roll of the leveler.

5. The device as claimed in claim 1, wherein the positioning means comprise at least two sets of positioning gauges placed toward each lateral edge of the plate vertically in line with a corresponding roll for accurately determining the position of the plate with respect to the corresponding roll in the leveling direction.

6. The device as claimed in claim 1, wherein the plate includes, on one edge transverse to the direction of leveling, adjustable bearing stops placed to bear against one of the end rolls, the entry roll, or the exit roll of the leveler and level with the axis of said roll.

7. A method for calibrating a multi-roll leveler to level a metal strip, the leveler having a set of lower rolls and a set of upper rolls, arranged approximately in a parallel manner, perpendicular to the leveling direction in which the strip to be leveled runs, the calibrating method comprising the steps:

placing a measurement metal plate between the set of upper rolls and the set of lower rolls, said plate extending approximately over the entire length of said rolls;

fastening strain gauges to the plate in several transverse rows, each located vertically in line with one of said rolls, on a face of the plate opposite that confronting a corresponding roll;

positioning said plate in the leveling direction;

adjusting the position of the plate so that each row of gauges is located vertically in line with a roll;

bringing confronting rolls closer together to exert a clamping force on the measurement plate; and measuring elastic deformations of the plate, with each roll located vertically in line with the gauges, by means of said gauges, in order to deduce therefrom the clamping force applied by the rolls in line with each gauge.

8. The method of calibrating a multi-roll leveler as claimed in claim 7, together with the step of subjecting the plate to adjustable stops until positioning sensors become located precisely in vertical alignment with a respective roll.

9. The method of calibrating a multi-roll leveler as claimed in claim 7, wherein the overall clamping force in various measured positions is determined and a spring curve for the leveler is deduced therefrom.

10. The method of calibrating a multi-roll leveler as claimed in claim 7, wherein rolls of the leveler are adjusted until the deformations measured by the gauges for a corresponding roll are equal and have predetermined values.

11. A method for calibrating a multi-roll leveler as claimed in claim 7, further comprising the steps:

locating at least one row of gauges so as to be placed vertically in line with one of the rolls located near an entry of the leveler and locating a row of gauges so as to be placed vertically in line with one of the rolls located toward an exit of the leveler;

adjustably positioning the plate so that each row of gauges is located vertically in line with a corresponding roll, and the two sets of rolls are brought closer together so as to exert a clamping force on the measurement plate; and the deformations undergone by the plate in line with each roll located vertically in line with the gauges are measured by means of said gauges, in order to deduce therefrom the clamping force applied by the rolls in line with each gauge.

12. A method for calibrating a multi-roll leveler as claimed in claim 7, together with the steps:

arranging one row of gauges having at least one gauge located on the a central line of the plate, and gauges toward each transverse edge of the plate;

adjustably positioning the plate so that each row of gauges is located vertically in line with a corresponding roll, and the two sets of rolls are brought closer together so as to exert a clamping force on the measurement plate; and the deformations undergone by the plate in line with each roll located vertically in line with the gauges are measured by means of said gauges, in order to deduce therefrom the clamping force applied by the rolls in line with each gauge.

13. A method for calibrating a multi-roll leveler, using the device as claimed in claim 7 together with the steps comprising:

arranging each row of gauges to have a central gauge and several lateral gauges placed so as to be located vertically in line with each roll of the leveler;

adjustably positioning the plate so that each row of gauges is located vertically in line with a corresponding roll, and the two sets of rolls are brought closer together so as to exert a clamping force on the measurement plate; and wherein the deformations undergone by the plate in line with each roll located vertically in line with the gauges are measured by means of said gauges, in order to deduce therefrom the clamping force applied by the rolls in line with each gauge.

14. A method for calibrating a multi-roll leveler as claimed in claim 7, together with the steps of:

locating at least two sets of positioning gauges toward each lateral edge of the plate vertically in line with a corresponding roll for accurately determining the position of the plate with respect to the corresponding roll in the leveling direction;

locating each row of gauges vertically in line with a corresponding roll;

bringing the sets of upper and lower rolls closer together to exert a clamping force on the measurement plate; and measuring with the gauges the deformations undergone by the plate in line with each roll located vertically in line with the gauges in order to deduce therefrom the clamping force applied by the rolls in line with each gauge.

15. A method for calibrating a multi-roll leveler, using the device as claimed in claim 7 and further comprising the steps:

subjecting one of the end rolls, the entry roll, or the exit roll of the leveler to bearing stops that are level with the axis of said roll;

locating each row of gauges vertically in line with a corresponding roll; and bringing the sets of upper and lower rolls closer together to exert a clamping force on the measurement plate; and measuring with the gauges the deformations undergone by the plate in line with each roll located vertically in line with the gauges in order to deduce therefrom the clamping force applied by the rolls in line with each gauge.

16. A multi-roll leveler having a calibrating device to level a metal strip undergoing leveling, comprising:

a set of lower rolls and a set of upper rolls, arranged approximately in a parallel manner, perpendicular to the leveling direction in which the strip to be leveled runs;

a measurement plate made of metal and placed between the set of upper rolls and the set of lower rolls, said plate extending approximately over the entire length of said rolls;

means for positioning said plate with respect to the rolls in the leveling direction; and strain gauges for measuring elastic deformations of the plate, said strain gauges being fastened to the plate so as to form several transverse rows of gauges each located vertically in line with one of said rolls, on a face of the plate opposite that confronting a corresponding roll.

* * * * *

UNITED STATES PATENT AND TRADEMARK OFFICE

CERTIFICATE OF CORRECTION

PATENT NO. : 6,993,947 B2
APPLICATION NO. : 10/416895
DATED : February 7, 2006
INVENTOR(S) : Fabrice Tondo et al.

It is certified that error appears in the above-identified patent and that said Letters Patent is hereby corrected as shown below:

Column 10, line 35, please delete “, using the”;

Column 10, line 36, please delete “device”.

Column 11, line 1, please delete “, using the”;

Column 11, line 2, please delete “device”.

Signed and Sealed this

Twenty-sixth Day of September, 2006

JON W. DUDAS
*Director of the United States Patent and Trademark Office*